US008428486B2

(12) United States Patent
Abe et al.

(10) Patent No.: US 8,428,486 B2
(45) Date of Patent: Apr. 23, 2013

(54) PROCESS UNIT FOR CONNECTING A PHOTOSENSITIVE UNIT WITH AN IMAGE FORMING APPARATUS

(75) Inventors: Koji Abe, Nagoya (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 718 days.

(21) Appl. No.: 12/625,588

(22) Filed: Nov. 25, 2009

(65) Prior Publication Data

US 2010/0135689 A1 Jun. 3, 2010

(30) Foreign Application Priority Data

Nov. 28, 2008 (JP) ..... 2008-304937

(51) Int. Cl.
*G03G 15/00* (2006.01)

(52) U.S. Cl.
USPC ..... 399/90

(58) Field of Classification Search ..... 399/90
See application file for complete search history.

(56) References Cited

U.S. PATENT DOCUMENTS

| | | | | |
|---|---|---|---|---|
| 5,521,693 | A * | 5/1996 | Kojima et al. | 399/228 |
| 8,301,054 | B2 * | 10/2012 | Tanabe et al. | 399/90 |
| 8,306,452 | B2 * | 11/2012 | Okabe | 399/110 |
| 2005/0008393 | A1 | 1/2005 | Kuma et al. | |
| 2007/0154233 | A1 * | 7/2007 | Ukai | 399/90 |
| 2007/0286632 | A1 | 12/2007 | Okabe | |
| 2008/0279579 | A1 | 11/2008 | Kuruma | |
| 2009/0169235 | A1 * | 7/2009 | Kamimura | 399/98 |
| 2010/0104312 | A1 * | 4/2010 | Kawai et al. | 399/88 |
| 2010/0135692 | A1 * | 6/2010 | Abe et al. | 399/111 |

FOREIGN PATENT DOCUMENTS

| | | |
|---|---|---|
| JP | 08-054817 | 2/1996 |
| JP | 2003-150022 | 5/2003 |
| JP | 2004-347728 | 12/2004 |
| JP | 2006-079128 | 3/2006 |
| JP | 2007-264469 | 10/2007 |
| JP | 2008-276117 | 11/2008 |

OTHER PUBLICATIONS

English machine translation of Japanese patent document, Kuruma (JP 2008-276117 A); "Color Electrophotographic Image Forming Apparatus"; by Kuruma, Tomoya; published Nov. 13, 2008.*
Office Action received for corresponding Japanese Patent Application 2008-304937 mailed Sep. 21, 2010.

* cited by examiner

*Primary Examiner* — David Gray
*Assistant Examiner* — Geoffrey Evans
(74) *Attorney, Agent, or Firm* — Banner & Witcoff, Ltd.

(57) ABSTRACT

A process unit and an image forming apparatus are provided. The process unit is slidably moutable on an apparatus main body of the image forming apparatus. The process unit includes plural photosensitive units which include photosensitive members, respectively, and are arranged at an interval, each of the photosensitive units including a unit contact, an electrode unit which electrically connects the photosensitive units to the apparatus main body. The electrode unit includes plural unit-side electrode members which come into contact with the unit contacts of the photosensitive units, respectively, a relay electrode member which comes into contact with the respective unit-side electrode members to electrically connect the respective unit-side electrode members, and a body-side electrode member which comes into contact with an apparatus main body contact provided in the apparatus main body.

17 Claims, 8 Drawing Sheets

PROCESS UNIT FOR CONNECTING A PHOTOSENSITIVE UNIT WITH AN IMAGE FORMING APPARATUS

CROSS-REFERENCE TO RELATED APPLICATION

This application claims priority from Japanese Patent Application No. 2008-304937, filed on Nov. 28, 2008, the entire subject matter of which is incorporated herein by reference.

TECHNICAL FIELD

Aspects of the present invention relate to an image forming apparatus such as an electrophotographic color printer, and a process unit mounted in the image forming apparatus.

BACKGROUND

An image forming apparatus such as an electrophotographic color printer includes photosensitive members which correspond to four colors (black, yellow, magenta, and cyan), respectively.

There has been known an image forming apparatus in which a charging device, a cleaning device, and the like are provided around each photosensitive member, and electric power is supplied to the charging device, the cleaning device and the like from a body of the image forming apparatus.

Further, an image forming apparatus includes four drum units having photosensitive drums corresponding to respective colors. Each of the drum units includes a developing roller electrode, a wire electrode, a grid electrode, and a cleaning electrode. The main body casing of the image forming apparatus includes contacts corresponding to the respective electrodes. When the drum units are mounted in the main body casing, the electrodes come into contact with the contacts, respectively.

In this image forming apparatus, each of the drum units includes a developing roller electrode, a wire electrode, a grid electrode, and a cleaning electrode.

Therefore, the main body casing is required to have the number of contacts corresponding to the respective electrodes, so that it is difficult to simplify the structure of the main body casing.

SUMMARY

Accordingly, it is an aspect of the present invention to provide an image forming apparatus which can electrically connect each photosensitive unit to an apparatus main body with simple structure, and a process unit mounted in the image forming apparatus.

According to an exemplary embodiment of the present invention, there is provided an image forming apparatus comprising: an apparatus main body which includes an apparatus main body contact; a plurality of photosensitive units which include photosensitive members, respectively, and are provided in parallel with each other and arranged in an arrangement direction at an interval, each of the photosensitive units including an unit contact; a process unit which includes the plurality of photosensitive units therein, and is provided to be slidable with respect to the apparatus main body in the arrangement direction; and an electrode unit which is provided in the process unit and electrically connects the photosensitive units to the apparatus main body. The electrode unit includes: a plurality of unit-side electrode members which come into contact with the unit contacts of the photosensitive units, respectively; a relay electrode member which comes into contact with the respective unit-side electrode members to electrically connect the respective unit-side electrode members; and a body-side electrode member which comes into contact with the apparatus main body contact.

According to another exemplary embodiment of the present invention, there is provided a process unit which is slidably mountable on an apparatus main body of an image forming apparatus. The process unit comprises: a plurality of photosensitive units which includes photosensitive members, respectively, and are provided in parallel with each other and arranged at an interval in a sliding direction of the process unit, each of the photosensitive units including a unit contact; and an electrode unit which electrically connects the photosensitive units to the apparatus main body. The electrode unit includes: a plurality of unit-side electrode members which come into contact with unit contacts of the photosensitive units, respectively; a relay electrode member which comes into contact with the respective unit-side electrode members to electrically connect the respective unit-side electrode members, and a body-side electrode member which comes into contact with an apparatus main body contact provided in the apparatus main body.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIGS. 7A and 7B are perspective views of an electrode plate shown in FIG. 6, wherein FIG. 7A is a view when viewed obliquely from a lower side and FIG. 7B is a view when viewed obliquely from an upper side.

DETAILED DESCRIPTION

1. Printer

Figure 1:
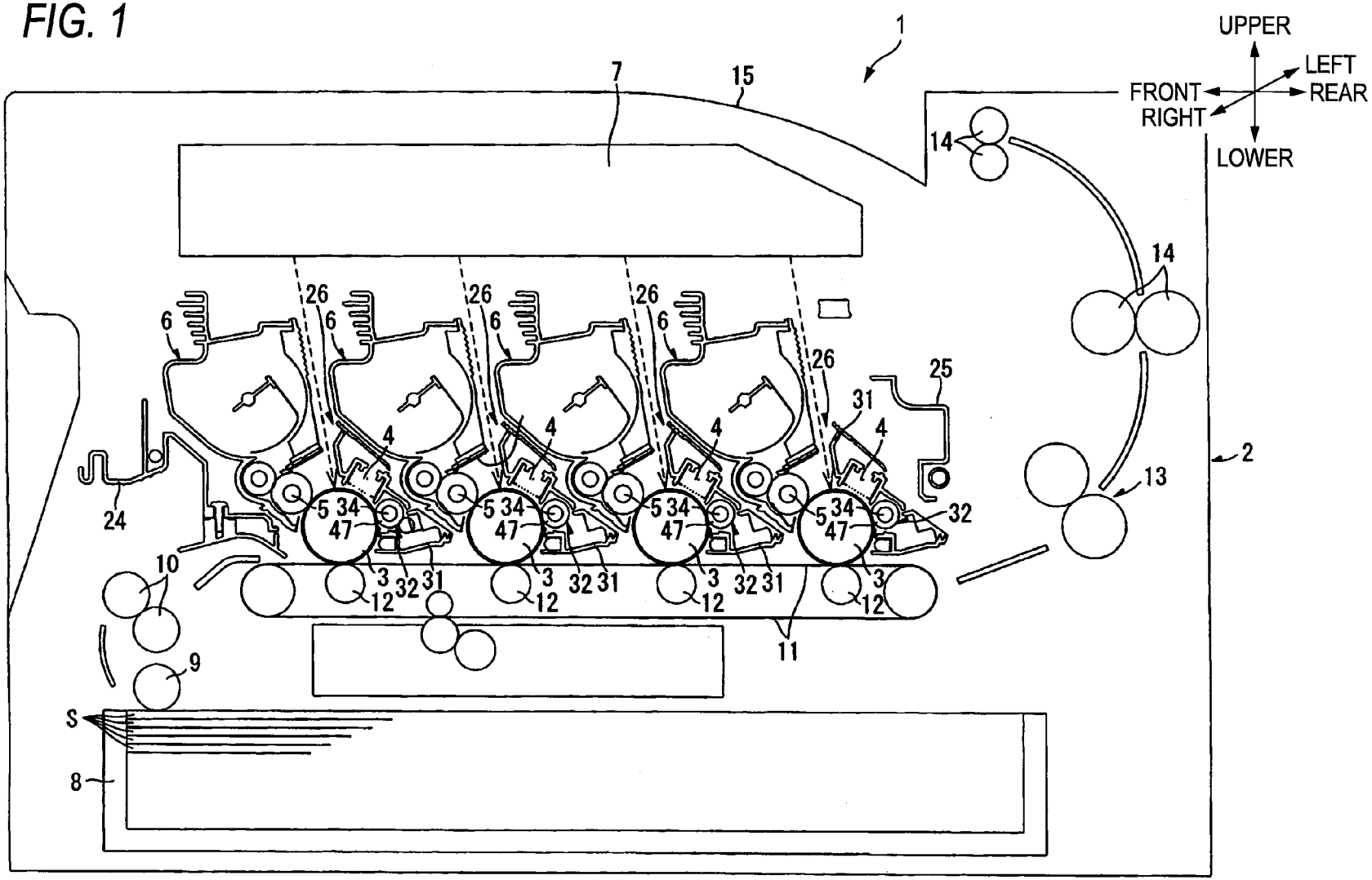
FIG. 1 is a side cross-sectional view of an embodiment of a printer as an example of an image forming apparatus according to the present invention.

Embodiments of the present invention will be described with reference to FIGS. 1 to 8. A printer 1 is shown in FIG. 1 as an example of an image forming apparatus according to an embodiment of the preset invention. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as the width direction, and the upper-lower direction is also referred to as the vertical direction. The left-right direction and the front-rear direction are also referred to as a horizontal direction. With regard to various individual components of the printer 1, sides of the individual components are similarly identified based on the arranged/attached position of the components on/in the printer 1.

The printer 1 is a color printer. As shown in FIG. 1, the printer 1 includes a main body casing 2 which has substantially the shape of a box extending in the front-back direction. A process unit 16 is provided in the main body casing 2 to be slidable in the front-back direction. The process unit 16 is detachably mounted in the main body casing 2 by sliding.

The process unit 16 is provided with four rotatable photosensitive drums 3 (an examples of photosensitive member). The photosensitive drums 3 are provided in parallel with each other and arranged in the front-back direction (arrangement direction) at intervals, and each of the photosensitive drums includes an earth shaft 17 (see FIG. 4) and bearing members 18 (see FIG. 4) which support both ends of the earth shaft 17.

Four scorotron-type chargers 4 are provided in the process unit 16 so as to oppose the photosensitive drums 3, respectively.

The process unit 16 includes four developing cartridges 6 which store yellow, magenta, cyan, and black toner (developer) and correspond to the photosensitive drums 3, respectively. Each of the developing cartridges 6 includes a developing roller 5 which is provided adjacent to the photosensitive drum 3 and opposes the corresponding photosensitive drum 3. Toner corresponding to the respective colors is carried on the surfaces of the developing rollers 5.

After being uniformly charged with electricity by the chargers 4, the surfaces of the respective photosensitive drums 3 are exposed to laser beams (see broken line arrows in FIG. 1) which are emitted from a scanner unit 7 provided at an upper portion of the main body casing 2. Accordingly, an electrostatic latent image based on image data is formed on the surface of each of the photosensitive drums 3. The electrostatic latent image of each of the photosensitive drums 3 is made visible by the toner having each color and is carried on the surface of the developing roller 5 corresponding to each of the photosensitive drums 3. Accordingly, a toner image having each color is formed on the surface of each of the photosensitive drums 3.

Sheets S are stacked in a sheet feed cassette 8 in an upper-lower direction, which is provided at a bottom of the main body casing 2. The uppermost sheet S of the sheets S stored in the sheet feed cassette 8 is fed forward by a sheet feed roller 9 which is provided above the front end of the sheet feed cassette 8.

After that, the sheet S is turned from the front side toward the rear side and enters between a pair of registration rollers 10. The pair of registration rollers 10 transports the sheet S to a front-side transport belt 11 at a predetermined timing.

The transport belt 11 is an endless belt, and four transfer rollers 12 are provided inside the transport belt. The respective transfer rollers 12 are provided to oppose the respective photosensitive drums 3 with the transport belt 11 interposed therebetween.

After that, the sheet S is transported by the transport belt 11. The transport belt 11 is rotated in a clockwise direction in FIG. 1, so that the sheet S placed on the upper portion of the transport belt is transported to the rear side from the front side. The toner images, which are formed on the surfaces of the respective photosensitive drums 3, are transferred to the sheet S, which is transported by the transport belt 11, by a transfer bias applied to the transfer rollers 12 and are sequentially superimposed. As a result, a color image is formed on the sheet S.

Then, the sheet S is transported to a rear-side fixing part 13 by the transport belt 11. The color image transferred to the sheet S is fixed by heat in the fixing part 13. After that, the sheet S is transported by transport rollers 14, is turned from the rear side toward the front side, and is discharged to a sheet discharge tray 15 which is provided at an upper portion of the main body casing 2.

2. Details of Process Unit

(2-1) Structure of Process Unit

Figure 2:
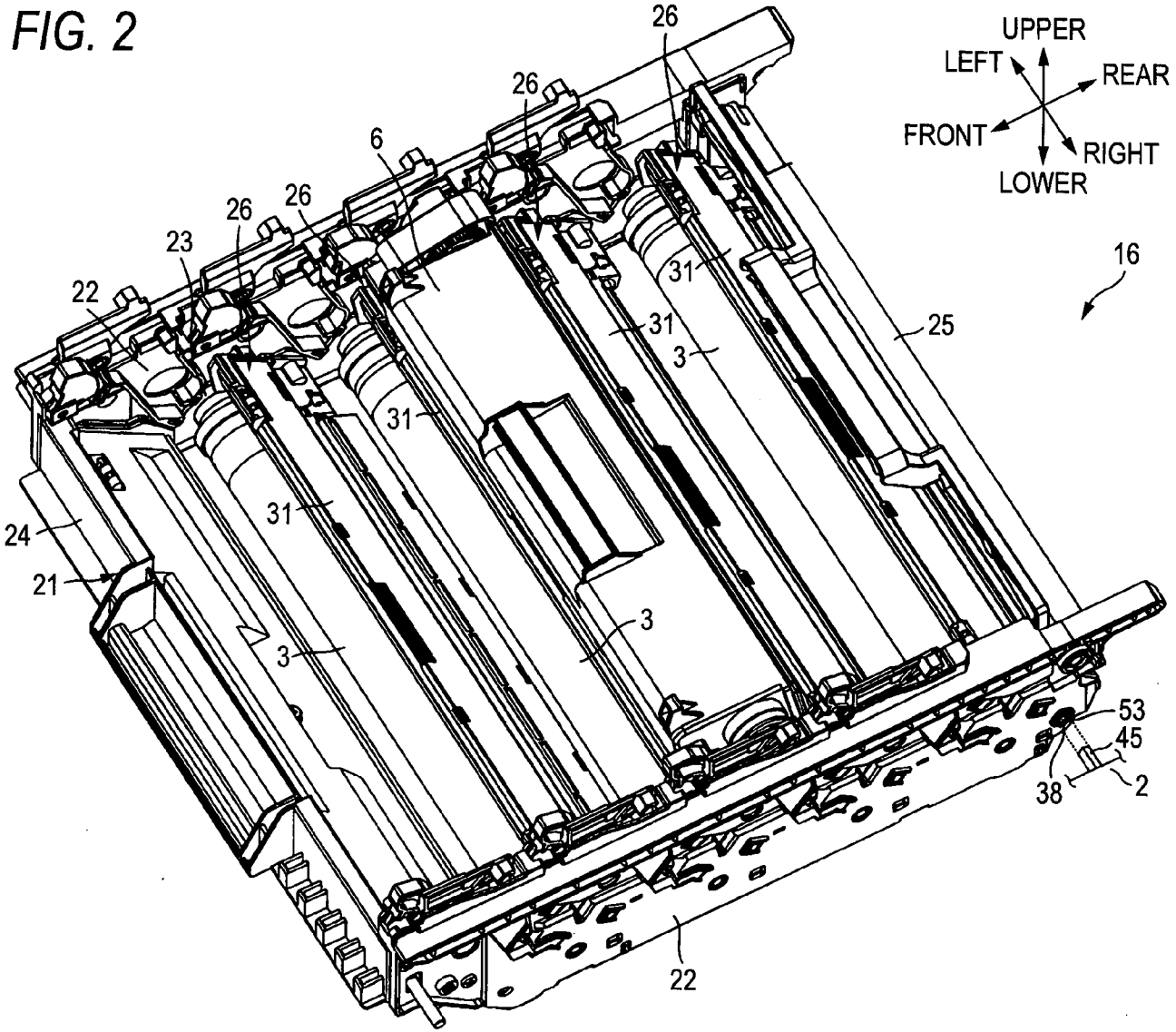
FIG. 2 is a perspective view of a process unit shown in FIG. 1.
Figure 3:
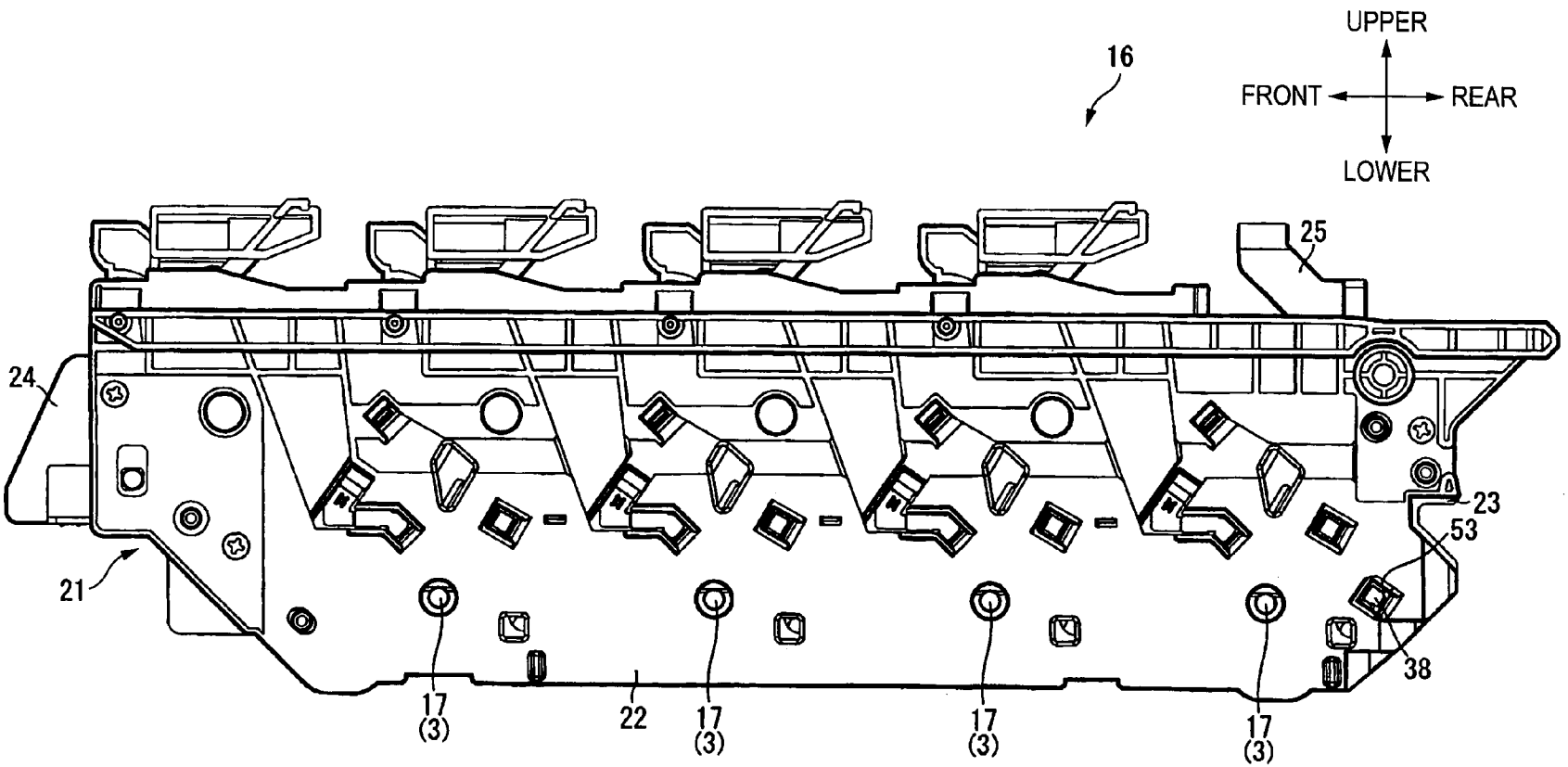
FIG. 3 is a right side view of the process unit shown in FIG. 2.

As shown in FIGS. 2 and 3, the process unit 16 includes a frame body 21 and a pair of side plates 22. The side plates oppose each other with a distance therebetween in the left-right direction so that the frame body 21 is interposed between the side plates 22.

The frame body 21 includes a pair of supporting plates 23, a front beam 24, and a rear beam 25 between the both side plates 22. The supporting plates opposes each other with a distance therebetween, the front beam 24 is provided between the front ends of the both supporting plate 23, and the rear beam is provided between the rear ends of both the supporting plates 23.

The frame body 21 includes four drum units 26 which are provided in parallel with each other at an interval between the front and rear beams 24 and 25.

In this embodiment, the structure relating to an electrode unit is provided on the right side and not provided on the left side of the process unit 16. Therefore, in the following description, the right side plate 22 and the right supporting plate 23 will be described in detail for the side plates 22 and the supporting plate 23. The right side plate 22 and the right supporting plate 23 are simply referred to as the side plate 22 and the supporting plate 23, respectively.

Figure 4:
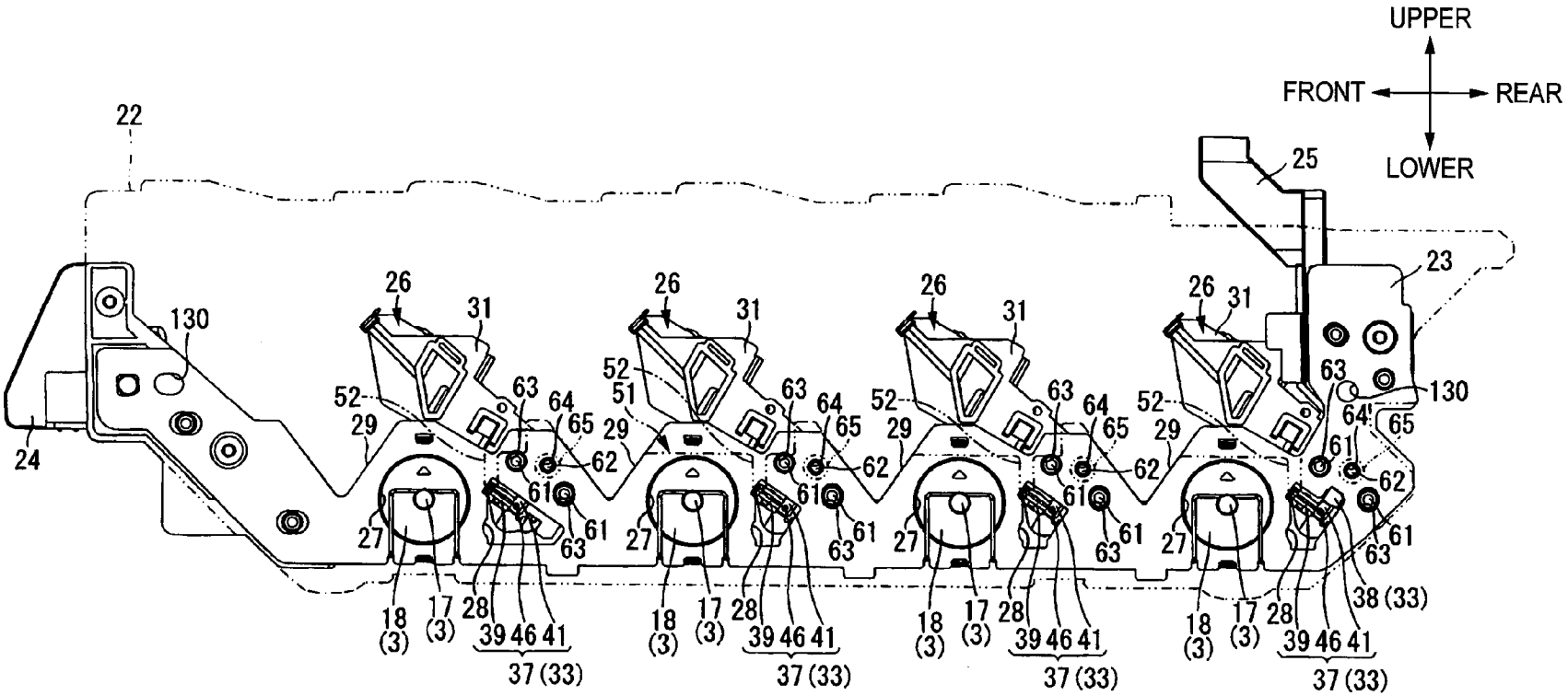
FIG. 4 is a right side view of the process unit shown in FIG. 2, in which side plates are removed.

As shown in FIG. 4, the supporting plate 23 is a flat plate extending in the front-back direction and is made of metal such as stainless steel.

Further, the supporting plate 23 includes drum support holes 27 which support the photosensitive drums 3, insertion holes 28 which are provided on the rear sides of the drum support holes 27, guide grooves 29 which are provided on the front sides of the drum support holes 27, and side plate positioning holes 130 which are provided at front and rear ends of the supporting plate 23, respectively.

The drum support hole 27 is formed to have a circular shape in side view. A bearing member 18 of the photosensitive drum 3 is inserted into the drum support hole, and is supported in not-rotatable manner. Accordingly, the supporting plates 23 support both ends of the photosensitive drums 3 in the left-right direction.

The insertion hole 28 is formed so that an electrode plate 33 (described below) can be inserted thereinto.

The guide groove 29 is formed by cutting out the supporting plate from the upper end edge of the supporting plate 23 toward the lower side into a V shape, of which an upper portion is opened, in side view. The guide groove 29 is formed so that a cartridge guiding portion 54 (described below) of the side plate 22 can be received.

Two frame positioning holes 63 are formed at the supporting plate 23 on the upper and rear sides of the insertion hole 28. The frame positioning hole 63, which is formed on the upper side of the insertion hole 28, is formed to have a circular shape in side view. The frame positioning hole 63 formed on the rear side of the insertion hole 28 is formed as an elongated hole, which extends in the upper-lower direction, in side view.

A screw hole 62, which has a diameter smaller than the diameter of the frame positioning hole 63, is formed at the supporting plate 23 between the frame positioning holes 63.

The respective side plate positioning holes 130 are provided so as to correspond to side plate positioning bosses 129 (described below) of the side plate 22, and are formed so as to receive the side plate positioning bosses 129 (described below). Specifically, the front side plate positioning hole 130 is formed as an elongated hole extending in the left-right direction, and the rear side plate positioning hole 130 is formed to have a substantially circular shape in side view.

Each of the front and second beams 24 and 25 is made of a hard resin or the like, and both ends of each of the front and second beams are fixed to the supporting plate 23 by screwing or the like.

Figure 5:
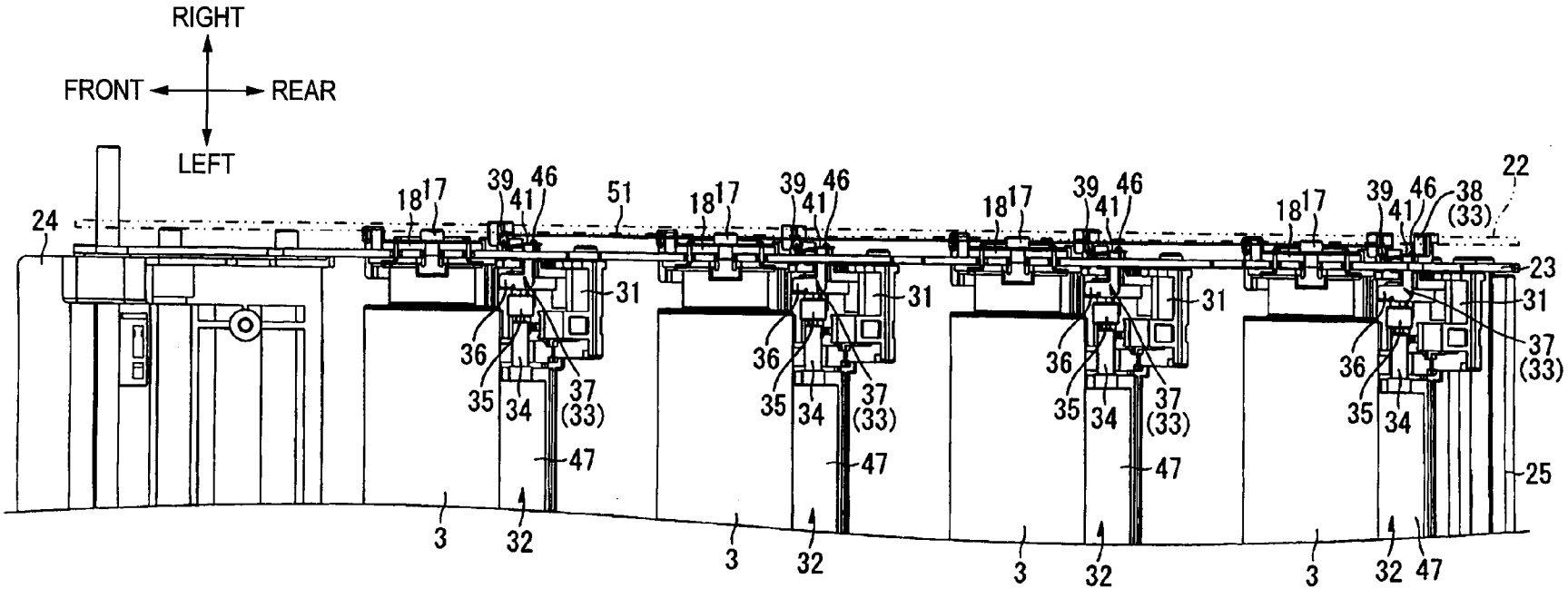
FIG. 5 is a bottom view of the process unit shown in FIG. 4.

As shown in FIGS. 2 and 5, each of the drum units 26 includes the photosensitive drum 3 and a center frame 31 (an example of a frame) which is provided between the supporting plates 23 so as to correspond to each photosensitive drum 3.

The center frame 31 is made of insulating resin or the like, and is fixed to the supporting plate 23 by screwing or the like.

Specifically, the center frame 31 includes two frame positioning bosses 61 which protrude from the right end of the center frame 31 toward the right side. Both frame positioning bosses 61 are provided with a distance therebetween in the front-back direction. Further, a screw hole 62 is formed at the right end of the center frame 31 between the both frame positioning bosses 61.

Both the frame positioning bosses 61 are inserted into the frame positioning holes 63 of the supporting plate 23 from the left side toward the right side, and a screw 65 is inserted into the screw insertion hole 64 of the supporting plate 23 from the right side toward the left side and is fastened to the screw hole 62 of the center frame 31. Accordingly, the center frame 31 is fixed to the supporting plate 23.

Figure 6:
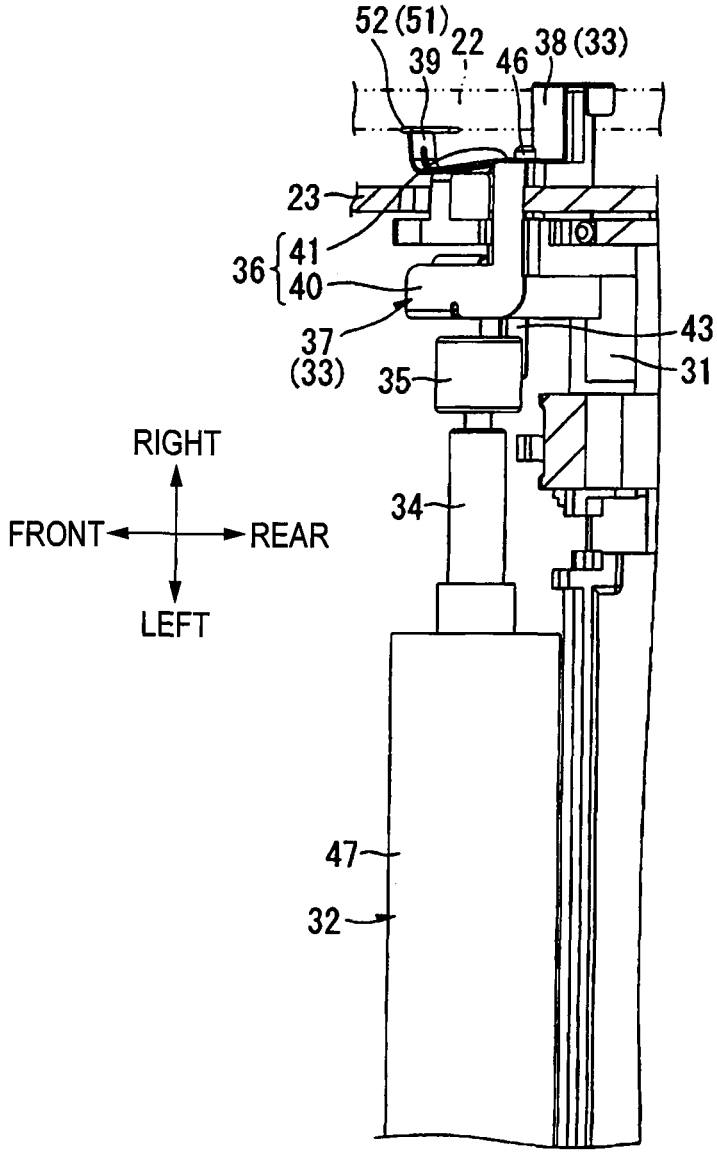
FIG. 6 is an enlarged view of main parts shown in FIG. 5.

Furthermore, as shown in FIGS. 4 and 6, the center frame 31 includes an electrode fixing boss 46 (an example of a protrusion) at the right end thereof. Additionally, a cleaning roller 32, an electrode plate 33, and the scorotron-type charger 4 are supported by the center frame 31 as described above.

The electrode fixing boss 46 is formed in the shape of a cylinder which protrudes from the right end face of the center frame 31 toward the right side, and is provided below the rear frame positioning boss 61.

The cleaning roller 32 is provided so as to come into contact with the photosensitive drum 3 from the rear side.

Further, the cleaning roller 32 includes a rotating shaft 34 which is made of metal, an elastic roller 47 which covers the rotating shaft 34, and bearings (not shown) which support both ends of the rotating shaft 34. The bearings (not shown) are rotatably supported by the center frame 31.

A rotating contact 35 (an example of a unit contact) is connected to the rightmost end of the rotating shaft 34 of the cleaning roller 32 to be rotatable with respect to the rotating shaft 34 and rotatable with respect to the electrode plate 33.

The rotating contact 35 is made of conductive resin to have a cylindrical shape, and is electrically connected to the rotating shaft 34 of the cleaning roller 32.

Figure 7A:
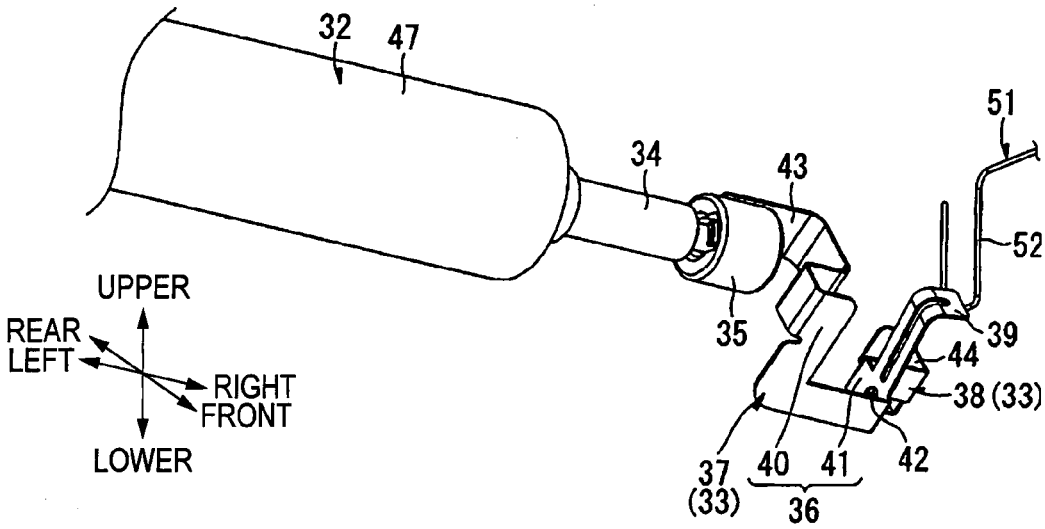
Figure 7B:
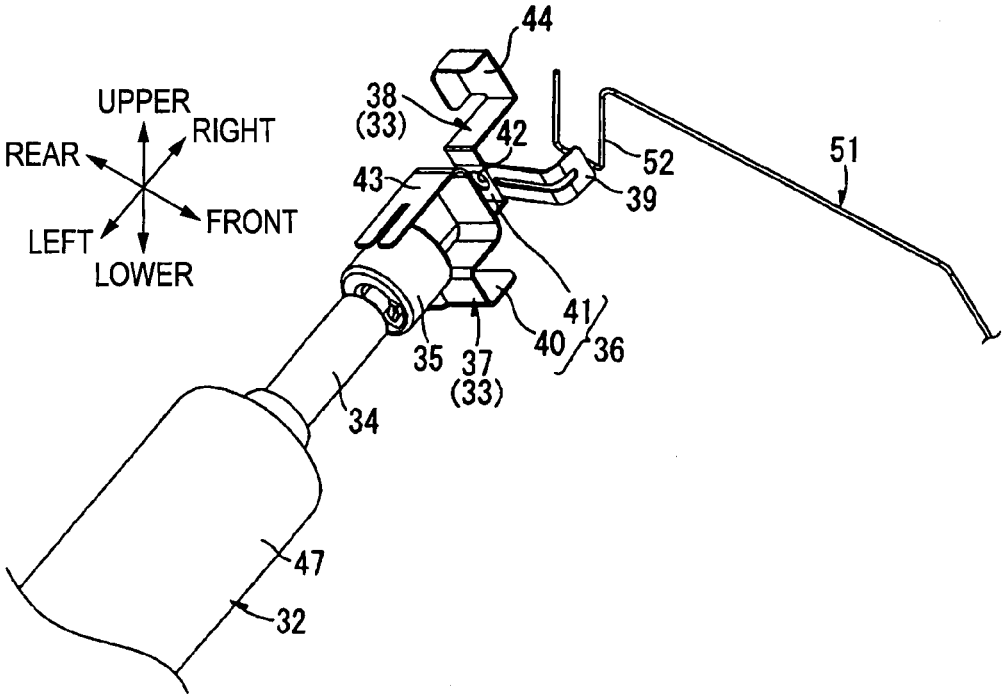

As shown in FIGS. 7A and 7B, the electrode plate 33 is made of metal, which has high conductivity, such as copper and includes a unit-side electrode 37 (an example of a unit-side electrode member).

The electrode plate 33, which is provided at the rearmost drum unit 26, further integrally includes a body-side electrode 38 (an example of a body-side electrode member).

The unit-side electrode 37 integrally includes a base 36, a terminal 43, and a lead electrode 39.

As shown in FIGS. 6 and 7, the base 36 includes a connecting part 40 which is formed in the shape of a substantially L-shaped plate, and a positioning plate 41 which extends from the right end edge of the connecting part 40 toward the rear upper side and has a rectangular shape in side view.

The connecting part 40 is obliquely provided so that the rear end edge of the connecting part 40 is provided on the lower side, and the front end edge thereof is provided on the upper side. Further, the connecting part 40 is formed to have a length longer than the thickness of the supporting plate 23 in the left-right direction.

The positioning plate 41 is formed along a direction, which opposes the rear upper side from the front lower side, so as to be orthogonal to the connecting part 40. Further, the positioning plate 41 is formed with a through hole 42, which passes through the positioning plate 41 in the left-right direction, at the central portion thereof in side view.

The terminal 43 is formed over the middle portion in the front-back direction from the front end edge of the base 36 at the left end edge of the base 36. The terminal 43 extends toward the rear upper side while being bent.

Specifically, the terminal 43 extends from the left end edge of the base 36 toward the rear upper side, and is bent so as to extend toward the right side. The terminal is further bent so as to extend toward the rear upper side by substantially the same length as the radial length of the rotating contact 35, and is further bent so as to extend toward the left side.

The left end of the terminal 43 is bifurcated, and comes into elastic contact with the rotating contact 35 of the cleaning roller 32 from the rear upper side.

The lead electrode 39 has a substantially L shape, and protrudes from the front end edge of the positioning plate 41 toward the front upper side. The protruding end of the lead electrode is bent toward the right side. The protruding end of the lead electrode 39 comes into contact with a relay electrode 51 (described below) of the side plate 22.

The body-side electrode 38 extends toward the right side from the rear upper end edge of the positioning plate 41. Further, the body-side electrode 38 includes a contact 44 at the right end edge thereof. The contact 44 has a rectangular shape in side view and extends toward the rear upper side.

The contact 44 comes into contact with a body contact 45 (an example of an apparatus main body contact), which is provided at the main body casing 2 (see FIG. 2).

As shown in FIGS. 4 and 6, the electrode fixing boss 46 of the center frame 31 is inserted into the through hole 42, so that the electrode plate 33 is fixed to the center frame 31.

Further, the electrode plate 33 is inserted into the insertion hole 28 of the supporting plate 23 so that the lead electrode 39 and the body-side electrode 38 are provided on the right side of the supporting plate 23. That is, the supporting plate 23 is provided between the rotating contact 35 and the body-side electrode 38.

Figure 8:
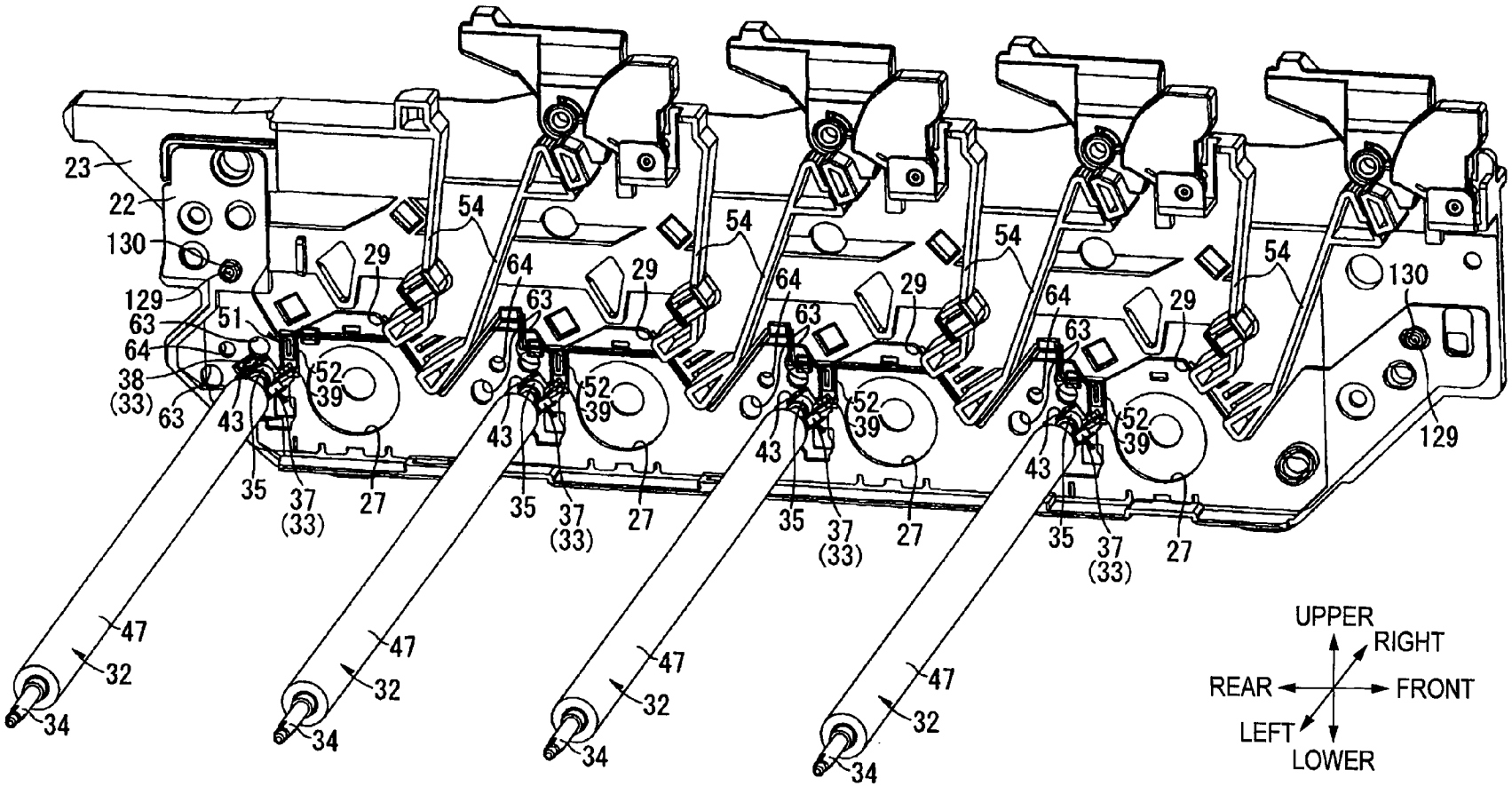
FIG. 8 is a view illustrating the assembly of the side plate to the process unit.

As shown in FIGS. 3 and 8, the side plate 22 includes four cartridge guiding portions 54 which are made of insulating resin, have a substantially rectangular shape in side view, and guide the developing cartridges 6 to be mounted, positioning bosses 129 which position the side plate 22 to the frame body 21, and the relay electrode 51 (an example of a relay electrode member). Further, the side plate 22 is formed with an opening 53, through which the body-side electrode 38 is exposed to the outside.

Each of the cartridge guiding portions 54 is formed of a protrusion which extends from the left surface of the side plate 22 toward the left side, and has a V shape, of which an upper portion is opened, in side view. Further, the respective cartridge guiding portions 54 are provided in parallel with each other and arranged at intervals in the front-back direction.

The side plate positioning boss 129 is formed in the shape of a cylinder which extends from the left surface of the side plate 22 toward the left side, and is provided in the middle of the side plate in the upper-lower direction at each of the front and rear ends of the side plate 22. The positioning boss 129 is inserted into the side plate positioning hole 130 of the supporting plate 23.

The relay electrode 51 is a conductive wire made of metal, and extends below the cartridge guiding portion 54 in the front-back direction while being bent in a substantially V shape so as not to interfere with the cartridge guiding portion 54. Further, the relay electrode 51 includes four terminal parts 52 which come into contact with the lead electrodes 39.

The relay electrode 51 configures an electrode unit together with the body-side electrode 38 and the respective unit-side electrodes 37.

Each of the terminal parts 52 is provided on the rear side of the corresponding cartridge guiding portion 54. Each of the terminal parts 52 is formed by bending the relay electrode in the substantially rectangular shape in side view so that the relay electrode 51 protrudes downward. The lower end edges of each terminal part 52 are provided at substantially the same position as the lower end edge of the cartridge guiding portion 54 in the upper-lower direction so as to come into contact with the lead electrode 39 (see FIG. 7).

The opening 53 has a substantially rectangular shape in side view, and is provided adjacent to and the rear side of the rearmost terminal part 52 below the rear end of the side plate 22 so as to correspond to the body-side electrode 38.

(2-2) Assembly of Side Plate

In order to assemble the side plate 22 to the frame body 21, as shown in FIG. 8, the body-side electrode 38 is inserted into the opening 53, the cartridge guiding portions 54 are fitted to the guide grooves 29, respectively, the side plate positioning bosses 129 are inserted into the side plate positioning holes 130, respectively, and the side plate 22 is assembled to the frame body 21 from the left side so that the side plate 22 is positioned to the frame body 21. The side plate 22 is fixed to the frame body 21 by screwing or the like.

When the side plate 22 is assembled to the frame body 21, the lead electrode 39 and the terminal part 52 come in elastic contact with each other in the left-right direction (see FIG. 6). Accordingly, each of the unit-side electrodes 37 and the relay electrode 51 come into elastic contact with each other, and the respective unit-side electrodes 37 are electrically connected to one another by the relay electrode 51.

(2-3) Supply of Electric Power to Process Unit

When the process unit 16 is mounted in the main body casing 2 while sliding from the front side toward the rear side, the contact 44 of the body-side electrode 38 comes into contact with the body contact 45 (see FIG. 2) of the main body casing 2. In this case, electric power is input to the body-side electrode 38 from an electrical power source (not shown) of the main body casing 2 through the body contact 45. Accordingly, electric power is input to the rearmost electrode plate 33.

The electric power, which is input to the body-side electrode 38, is distributed to the rotating contacts 35 of the cleaning rollers 32 through the terminals 43 of the unit-side electrodes 37. At the same time, the electric power, which is input to the body-side electrode 38, is distributed to the relay electrode 51 through the lead electrodes 39 of the unit-side electrodes 37.

The electric power, which is distributed to the relay electrode 51, is distributed to three other electrode plates 33 which come into contact with the relay electrode 51. Specifically, electric power is supplied to the lead electrodes 39 from the terminal parts 52 of the relay electrode 51, respectively.

The electric power, which is distributed to the three different electrode plates 33, is distributed to the rotating contacts 35 of the corresponding cleaning rollers 32 through the terminals 43.

Accordingly, the electric power, which is input to the body-side electrode 38 from the main body casing 2, is distributed to the respective cleaning rollers 32 through the relay electrode 51 and the respective unit-side electrodes 37. That is, the drum units 26 including the cleaning rollers 32 are electrically connected to the main body casing 2 by the electrode unit (the body-side electrode 38, the respective unit-side electrodes 37, and the relay electrode 51).

3. Advantage (1) According to the process unit 16, as shown in FIGS. 2 and 8, the process unit 16 includes four drum units 26 and the electrode unit which electrically connects the respective drum units 26 to the main body casing 2. The electrode unit includes four unit-side electrodes 37 which come into contact with the rotating contacts 35 provided at the respective drum units 26, the relay electrode 51 which comes into contact with the respective unit-side electrodes 37 so as to electrically connect the unit-side electrodes 37, and the body-side electrode 38 which comes into contact with the body contact 45.

Accordingly, the electric power, which is input to the body-side electrode 38 from the body contact 45, is distributed to the respective unit-side electrodes 37 through the relay electrode 51, and is supplied to the respective rotating contacts 35 which come into contact with the respective unit-side electrodes 37. Accordingly, it is possible to electrically connect each of the drum units 26 to the main body casing 2.

As described above, since it is possible to electrically connect the respective unit-side electrodes 37 by the relay electrode 51 and make the respective unit-side electrodes as a collective, it is possible to reduce the number of body-side electrodes 38 with respect to the number of the unit-side electrodes 37.

Therefore, it is possible to electrically connect each of the drum units 26 to the main body casing 2 with a simple structure and at low cost.

(2) Further, according to the printer 1, as shown in FIG. 3, the body-side electrode 38 is provided at a position corresponding to the drum unit 26 at a most downstream side in a sliding direction in which the process unit 16 is mounted.

Accordingly, the body-side electrode 38 comes into contact with the body contact 45 for the first time when being completely mounted in the main body casing 2 of the process unit 16.

Therefore, it is possible to prevent the damage to the body contact 45 which is caused by the contact between the body contact and portions of the process unit 16 except for the body-side electrode 38 during the mounting of the process unit 16.

(3) Further, according to the printer 1 and the process unit 16, as shown in FIG. 8, the relay electrode 51 is provided on the side plate 22 which is made of insulating resin.

Therefore, it is possible to simultaneously perform the wiring of the relay electrode 51 and the assembly of the side plate 22 to the process unit 16, and to easily assemble the relay electrode 51 to the process unit 16.

Further, since the side plate 22 itself has insulating property, it is possible to prevent the short circuit of the relay electrode 51.

(4) According to the process unit 16, as shown in FIG. 6, the supporting plate 23 is provided between the rotating contact 35 and the body-side electrode 38. That is, when the process unit 16 is mounted in the main body casing 2, the supporting plate 23 is provided between the rotating contact 35 and the body contact 45.

Therefore, it is possible to easily make the body-side electrode 38 come into contact with the body contact 45.

(5) Further, according to the process unit 16, as shown in FIG. 6, the unit-side electrode 37 and the body-side electrode 38 are formed of one electrode plate 33, and the electrode plate 33 is inserted into the insertion hole 28 formed at the supporting plate 23.

Therefore, it is possible to simplify the structure of the electrode unit and to reduce the number of parts of the electrode unit.

Since it is possible to make the body-side electrode 38 be inserted into the supporting plate 23 and protrude from the process unit 16 to the outside, it is possible to more easily make the body-side electrode 38 come into contact with the body contact 45.

(6) Further, according to the process unit 16, the center frame 31 including the unit-side electrode 37 is fixed to the supporting plate 23.

Therefore, it is possible to fix each of the unit-side electrodes 37 to the supporting plate 23 through each of the center frames 31, and to more accurately position each of the unit-side electrodes 37.

Accordingly, it is possible to make each of the unit-side electrodes 37 be accurately positioned to the relay electrode 51 and come into contact with the relay electrode 51.

(7) Further, according to the process unit 16, as shown in FIGS. 4 and 6, the unit-side electrode 37 is fixed to the center frame 31 by inserting the electrode fixing boss 46 into the through hole 42 of the positioning plate 41 extending in the front-back direction, which is orthogonal to a contact direction (left-right direction) in which the unit-side electrode 37 and the relay electrode 51 come into contact with each other, from the left side to the right side.

Therefore, it is possible to stably receive the stress, which is applied to the unit-side electrode 37 from the relay electrode 51 by the contact between the relay electrode 51 and the unit-side electrode, by the positioning plate 41 which is orthogonal to the direction of application of the stress (the left-right direction).

Accordingly, it is possible to make each of the unit-side electrodes 37 stably come into contact with the relay electrode 51.

(8) Further, according to the printer 1 and the process unit 16, as shown in FIG. 6, each of the respective unit-side electrodes 37 comes into elastic contact with the relay electrode 51.

Therefore, it is possible to make each of the unit-side electrodes 37 more stably come into contact with the relay electrode 51.

(9) Further, according to the process unit 16, as shown in FIG. 7, the unit-side electrode 37 comes into elastic contact with the rotating contact 35 from the rear upper side, and the contact direction (front-back direction) in which the unit-side electrode comes into elastic contact with the rotating contact is orthogonal to the contact direction (left-right direction) where the unit-side electrode 37 comes into contact with the relay electrode 51.

Accordingly, the stress, which is applied to the unit-side electrode 37 by the contact between the rotating contact 35 and the unit-side electrode, is orthogonal to the stress that is applied to the unit-side electrode 37 by the contact between the relay electrode 51 and the unit-side electrode. Therefore, it is possible to prevent the stresses from having an influence on each other.

Consequently, it is possible to make the unit-side electrode 37 stably come into contact with both the rotating contact 35 and the relay electrode 51.

(10) Further, according to the process unit 16, the unit-side electrode 37 applies a voltage to the cleaning roller 32.

Therefore, it is possible to reduce the number of body-side electrodes 38 of the electrode unit for the cleaning rollers 32.

Consequently, it is possible to electrically connect the cleaning roller 32 of each drum unit 26 to the main body casing 2 with a simple structure.

While the present invention has been shown and described with reference to certain exemplary embodiments thereof, it will be understood by those skilled in the art that various changes in form and details may be made therein without departing from the spirit and scope of the invention as defined by the appended claims.

For example, in the above-described embodiments, the photosensitive drums 3 are employed. However, the photosensitive belts can be also employed instead of the photosensitive drums 3.

What is claimed is:

1. An image forming apparatus comprising:

an apparatus main body including an apparatus main body contact;

a plurality of photosensitive units which include photosensitive members, respectively, and are provided in parallel with each other and arranged in an arrangement direction at an interval, each of the photosensitive units including a unit contact;

a process unit including the plurality of photosensitive units therein, and provided to be slidable with respect to the apparatus main body in the arrangement direction; and an electrode unit provided in the process unit and configured to electrically connect the photosensitive units to the apparatus main body, wherein each photosensitive unit includes a frame made of insulating resin, and the frame includes a protrusion which protrudes outward in a longitudinal direction of the photosensitive member, wherein the electrode unit includes:

a plurality of unit-side electrode members which come into contact with the unit contacts of the photosensitive units, respectively;

a relay electrode member which comes into contact with the respective unit-side electrode members to electrically connect the respective unit-side electrode members; and a body-side electrode member which comes into contact with the apparatus main body contact, wherein at least one of the unit-side electrode members includes a positioning plate orthogonal to a contact direction in which the at least one of the unit-side electrode members comes into contact with the relay electrode member, wherein the positioning plate is formed with a through hole which passes through the positioning plate in the contact direction, and wherein the protrusion is insertable into the through hole so that the at least one of the unit-side electrode members is positioned to the frame.

2. The image forming apparatus according to claim 1, wherein the process unit is configured to be detachably mounted in the main body casing by sliding, and wherein the body-side electrode member is provided in the process unit at a position corresponding to the photosensitive unit provided at a most downstream side in a sliding direction in which the process unit is mounted.

3. The image forming apparatus according to claim 1, wherein the process unit includes:

a pair of side plates made of insulating resin, and provided so as to oppose each other with a distance therebetween in the longitudinal direction of the photosensitive member, and a pair of supporting plates provided between the side plates so as to oppose each other with a distance therebetween, and support both ends of the photosensitive members in the longitudinal direction, and wherein the relay electrode member is provided on one of the side plates.

4. The image forming apparatus according to claim 3, wherein one of the supporting plates is provided between the unit contacts and the apparatus main body contact.

5. The image forming apparatus according to claim 3, wherein the at least one of the unit-side electrode members and the body-side electrode member are formed of one electrode plate, wherein the supporting plate is formed with an insertion hole, and wherein the electrode plate is inserted into the insertion hole.

6. The image forming apparatus according to claim 3, wherein the frame is fixed to the supporting plate, and wherein the unit-side electrode members are provided on the frame.

7. The image forming apparatus according to claim 1, wherein each of the unit-side electrode members and the relay electrode member come in elastic contact with each other.

8. The image forming apparatus according to claim 7, wherein each of the unit-side electrode members comes in elastic contact with the respective unit contact, and wherein a contact direction in which each of the unit-side electrode members comes into contact with the unit contact is orthogonal to a contact direction in which each of the unit-side electrode members comes into contact with the relay electrode member.

9. The image forming apparatus according to claim 1, wherein each of the photosensitive units includes a cleaning roller configured to clean developer remaining on the photosensitive member after the formation of an image, and wherein the at least one of the unit-side electrode members is configured to apply a voltage to the cleaning roller.

10. A process unit configured to be slidably mountable on an apparatus main body of an image forming apparatus, the process unit comprising:

a plurality of photosensitive units including photosensitive members, respectively, and provided in parallel with each other and arranged at an interval in a sliding direction of the process unit, each of the photosensitive units including an unit contact; and an electrode unit configured to electrically connect the photosensitive units to the apparatus main body, wherein each photosensitive unit includes a frame made of insulating resin, and the frame includes a protrusion which protrudes outward in a longitudinal direction of the photosensitive member, wherein the electrode unit includes:

a plurality of unit-side electrode members which come into contact with unit contacts of the photosensitive units, respectively;

a relay electrode member which comes into contact with the respective unit-side electrode members to electrically connect the respective unit-side electrode members, and a body-side electrode member which comes into contact with an apparatus main body contact provided in the apparatus main body, wherein at least one of the unit-side electrode members includes a positioning plate orthogonal to a contact direction in which the at least one of the unit-side electrode members comes into contact with the relay electrode member, wherein the positioning plate is formed with a through hole which passes through the positioning plate in the contact direction, and wherein the protrusion is insertable into the through hole so that the at least one of the unit-side electrode members is positioned to the frame.

11. The process unit according to claim 10, further comprising:

a pair of side plates made of insulating resin, and provided so as to oppose each other with a distance therebetween in the longitudinal direction of the photosensitive member; and a pair of supporting plates provided between the side plates so as to oppose each other with a distance therebetween, and support both ends of the photosensitive members in the longitudinal direction, wherein the relay electrode member is provided on one of the side plates.

12. The process unit according to claim 11, wherein one of the supporting plates is provided between the unit contacts and the body-side electrode member.

13. The process unit according to claim 11, wherein the at least one of the unit-side electrode members and the body-side electrode member are formed of one electrode plate, wherein the supporting plate is formed with an insertion hole, and wherein the electrode plate is inserted into the insertion hole.

14. The process unit according to claim 11, wherein the frame is fixed to the supporting plate, and wherein the unit-side electrode members are provided on the frame.

15. The process unit according to claim 10, wherein each of the unit-side electrode members and the relay electrode member come in elastic contact with each other.

16. The process unit according to claim 15, wherein each of the unit-side electrode members comes in elastic contact with the respective unit contact, and wherein a contact direction in which each of the unit-side electrode members comes into contact with the respective unit contact is orthogonal to a contact direction in which each the unit-side electrode members comes into contact with the relay electrode member.

17. The process unit according to claim 10, wherein each of the photosensitive units includes a cleaning roller configured to clean developer remaining on the photosensitive member after the formation of an image, and wherein the at least one of the unit-side electrode members is configured to apply a voltage to the cleaning roller.

* * * * *